United States Patent [19]

Hofstetter

[11] Patent Number: 4,624,021

[45] Date of Patent: Nov. 25, 1986

[54] CUSHION-LIKE SUPPORT

[76] Inventor: Jean A. Hofstetter, 4572 Doverdell Dr., Pittsburgh, Pa. 15236

[21] Appl. No.: 700,099

[22] Filed: Feb. 11, 1985

[51] Int. Cl.[4] ..... A47G 9/00

[52] U.S. Cl. ..... 5/431; 5/436; 5/443

[58] Field of Search ..... 5/431, 436, 448, 434, 5/443; D6/601

[56] References Cited

U.S. PATENT DOCUMENTS

| | | | |
|---|---|---|---|
| D. 260,591 | 9/1981 | Eischen, Sr. | D6/201 |
| D. 276,938 | 12/1984 | Pedersen | D6/601 |
| D. 277,316 | 1/1985 | Meares | D6/601 |
| 2,521,530 | 9/1950 | McGuffage . | |
| 2,720,660 | 10/1955 | Smith | 5/436 |
| 3,604,023 | 9/1971 | Lynch . | |
| 3,667,074 | 6/1972 | Emery | 5/436 |
| 4,173,048 | 11/1979 | Varaney | 5/436 |
| 4,177,806 | 12/1979 | Griffin | 128/132 R |
| 4,397,052 | 8/1983 | Lund, III | 5/431 |
| 4,424,599 | 1/1984 | Hannouche | 5/434 |

*Primary Examiner*—Alexander Grosz

*Attorney, Agent, or Firm*—Webb, Burden, Robinson & Webb

[57] ABSTRACT

The present invention provides a specialized cushion-like support having an arcuate body and a neck attached thereto. The cushion-like support fits adjacent the torso and between the legs of the user, thus separating the legs and supporting the upper arm, shoulders, spine and back. The neck of the cushion-like support functions as a bolster, preventing the torso of the user from twisting or rolling forward, and the body of the support minimizes or eliminates friction and pressure gradients between the legs as the user sleeps or rests on his side. The cushion-like support is designed for use as a regular sleep support for both children and adults, is easily adapted into a stuffed toy for children, and is particularly well-suited, in therapeutic bed rest and hospital applications, for minimizing fatigue in the arms, shoulders and back and for preventing abrasion, pressure points and decubitus ulceration on the lower limbs and extremities.

2 Claims, 4 Drawing Figures

CUSHION-LIKE SUPPORT

FIELD OF THE INVENTION

The present invention relates to a cushion-like support designed for use by an adult or a child reclining on his side.

INTRODUCTION

The fetal position, for a number of physiologic and psychologic reasons, is the best known position for sleeping. This position, in which an adult or a child lies on his side with his knees draw up, is the postnatal version of the characteristic posture of a fetus supported in amniotic fluid. Unfortunately, only a fetus or an otherwise submerged human form can experience the equilibrium of the true fetal position: gravity necessarily destroys the balanced support afforded by the surrounding fluid when the fluid is removed or absent. For this reason, the fetal position assumed by a sleeping or resting person is only an anatomic approximation of the true, fluid-supported fetal posture.

More particularly, a person reclining in the fetal position experiences significant stress and trauma at various body loci. For example, the upper knee (the one furthest from the bed or other supporting surface) presses down against the lower knee with adequate force to cause discomfort and tissue trauma, to impair circulation and to create a serious risk of decubitus ulceration in an immobilized or debilitated patient. This trauma persists even if the knees are readjusted to a modified fetal position (in which the knees and/or ankles are nonaligned) because one or both knees continue to press against the opposite leg at the locus of contact. A similar trauma occurs between the ankles and, to a lesser degree, between the feet, calves and thighs. As a result, sleepers and other resting or bedfast persons have need of support arrangement which will eliminate pressure points between the legs, permit good circulation and increase the comfort, stability and safety of the otherwise beneficial fetal position.

Trauma created by the upper leg is not the only anatomic stress associated with the fetal position or its variations. The torso, as a person reclines on his side, is prevented from rolling forward primarily by the extended knees. The extended knees do not, however, prevent the shoulder area of the torso from rolling forward. As the shoulders roll, therefore, the spine and back twist unnaturally, i.e., the shoulders and the pelvis are no longer aligned in the same plane. (The reclining person may, of course, rotate his pelvis forward to align it with his shoulders, but by doing so will only increase the force exerted by the upper leg.) In addition, the unsupported upper shoulder and upper arm tend to pull forward and slump downward, and the reclining person instinctively seeks to counteract gravity by contracting the muscles in his neck and upper back. The contracted muscles then contribute to tension, fatigue and impaired circulation. Anyone who regularly assumes the fetal position, therefore, needs a support which, in addition to supporting the legs, will also support the upper arm, shoulders, spine and back.

BRIEF DESCRIPTION OF THE INVENTION

In order to meet this need, the present invention provides a specialized cushion-like support having an arcuate body and a neck attached thereto. The cushion-like support fits adjacent the torso and between the legs of the user, thus separating the legs and supporting the upper arm, shoulders, spine and back. The neck of the cushion-like support functions as a bolster, preventing the torso of the user from twisting or rolling forward, and the body of the support minimizes or eliminates friction and pressure gradients between the legs as the user sleeps or rests on his side. The cushion-like support is designed for use as a regular sleep support for both children and adults, is easily adapted into a stuffed toy for children, and is particularly well-suited, in therapeutic bed rest and hospital applications, for minimizing fatigue in the arms, shoulders and back and for preventing abrasion, pressure points and decubitus ulceration on the lower limbs and extremities.

DETAILED DESCRIPTION OF THE INVENTION

Figure 1:
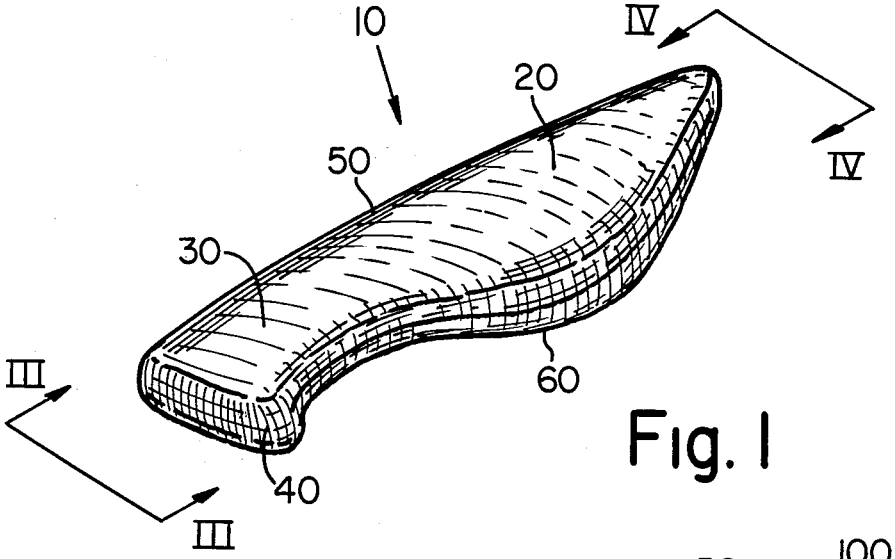
FIG. 1 is a perspective view of the cushion-like support.

Referring now to the drawings and initially to FIG. 1, the cushion-like support 10 has a body 20 and a neck 30. The body 20 is arcuate and the neck 30 has an optional flared terminus 40. The arcuate body 20 and the neck 30 form a continuous structure having a distinctive shape.

Figure 2:
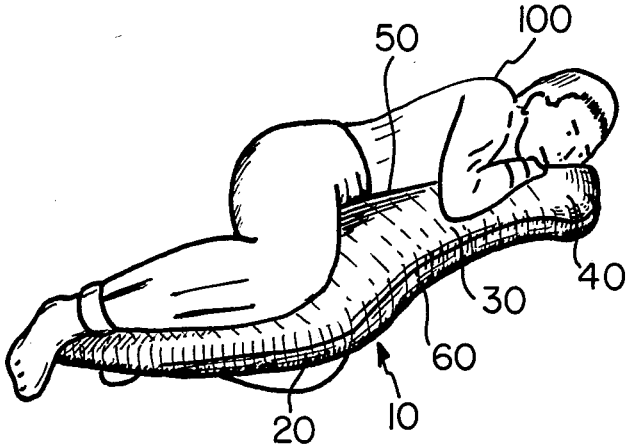
FIG. 2 is a perspective view of the invention as it supports the user lying on his side in the fetal position.
Figure 3:
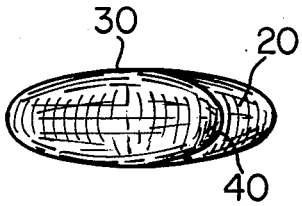
FIG. 3 is a side elevational view of the cushion-like support, taken along line III—III of FIG. 1.
Figure 4:
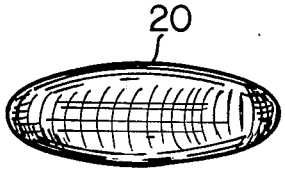
FIG. 4 is a side elevational view of the cushion-like support, taken along line IV—IV of FIG. 1.

Referring now to FIG. 2, the user 100 rests against the proximal surface 50 of the cushion-like support 10 and extends his knees, on either side of the invention, toward the distal surface 60 of the support. The arcuate body 20 of the support 10 is thus disposed between the legs of the user 100, separating the knees and ankles. The neck 30 of the support 10 bolsters the torso of the user 100 and also supports his arm and shoulder.

Referring again to FIG. 1, the neck 30 appends from the arcuate body 20 to form a continuous cushion-like support 10 having a proximal surface 50 and a distal surface 60. The neck 30 is, therefore, a narrowed section of the cushion-like support structure which, although it may vary somewhat in shape, is generally a neck-shaped segment which is substantially straight along the proximal surface 50 of the cushion-like support 10. The neck 30 may have an optional flared terminus 40. The substantially straight proximal surface of the neck 30 fits against and bolsters the torso of a person lying on his side, and extends preferably from between the pelvis and the waist to about at least the sternum of the user, and more preferably to about at least the shoulder area of the user.

The distinctive shape of the cushion-like support results, in large part, from the distinctive shape of the arcuate body of the support. The distinctive shape of the arcuate body 20 inheres in its arcuate distal surface. By the term "arcuate," applicant signifies a curve or angle having one maximum and two minima. Thus, the arcuate distal surface flares out to a maximum from a minimum at either end of the arcuate body. More specifically, in the general region of the distal surface 60 where the neck 30 appends from the arcuate body 20, the distal surface 60 gradually flares away from the proximal surface 50 and away from the neck 30 to a maximum, and then gradually tapers in until it intersects with the proximal surface 50 at the end of the arcuate body 20 which opposes the neck 30. The flaring and tapering arcuate distal surface may describe an angle or a curve, but preferably describes a smooth curve. The exact shape of the arcuate body 20 may, therefore vary—as long as the widest portion falls within the middle 80% of its length. Because of this shape, the arcuate body 20 fits between and separates the legs of a person lying on his side with his knees drawn up.

It is not necessary that the proximal surface 50 of the arcuate body 20 be substantially straight; whereas the neck 30 must fit against the torso, the arcuate body 20 fits between the legs and the majority of its proximal surface does not ordinarily contact the body in any way. Preferably, however, the arcuate body 20 will have a proximal surface which is substantially straight in order to broaden the utility of the support 10 (as described below).

OPERATION

As shown in FIG. 2, the user 100, in order to use the support 10, pulls the support 10 adjacent and parallel to his own reclining position. He places one knee on either side of the arcuate body 20 and draws his knees up into a comfortable position. The neck 30 is then pressed securely against the torso. After the neck is properly positioned, the user then rests his upper arm atop the neck 30 to support both his upper arm and his shoulder. After the support 10 is in position, the user may change or alter his position as desired, while keeping the support against his torso and between his legs.

The optional flared terminus 40 of the neck 30 functions as a head pillow should the user 100 choose to pull the terminus 40 past his chin and bend his head forward to rest on it. (Use of the flared terminus 40 as a head pillow is optional, however, due to the ready availability of standard head pillows.) Alternatively, the flared terminus 40 may be drawn up under the chin or may be positioned clear of the face entirely while still supporting the torso and the upper arm and shoulder. The flared terminus 40 can be any widening of the neck 30 at the end of the neck 30 which opposes the arcuate body 20.

When the proximal surface of the arcuate body 20 is substantially straight, the cushion-like support 10 can function as more than a support for the fetal position. The proximal surface 50 of the support 10, if substantially straight, yields a support which can serve as a bolster for any sleeping position in the same manner as a conventional straight bolster. In addition, however, the user may use the support by aligning it against his own straightened lower leg and drawing up only the upper knee. This "leg-over" position is a good alternative sleeping posture and the cushion-like support enhances its comfort and stability in the same manner as it supports the fetal posture.

An unlimited variety of materials and fabrics are suitable for use in the fabrication of the cushion-like support. The support itself is fashioned of a suitable cushioning material, which may range from very soft to very firm, covered with a permanent outer covering of any suitable sheet material. Preferably, the cushion-like support also has a removable, washable slipcover. The cushioning material may be any cushioning material known in the art or may be selected from among the polyamidoester foams (polyisocyanate, polycarbonate, polyurethane) or polyamidoester battings, other synthetic foams or battings, foamed or nonfoamed rubbers, synthetic fibers, or the natural fibers such as wool, cotton, flax, etc. The cushioning material may also be air, in an inflatable support. The outer covering may be made of synthetic sheet materials, either porous or nonporous, or any textiles, such as wool, cotton, linen unbleached muslin, polyester, polypropylene, nylon, or other suitable fabrics and materials. The removable, washable slipcover may be made of sheepskin, leather, synthetic sheet materials, or synthetic or natural textiles, animal skins or furs. Preferably, the slipcover of the cushion-like support is constructed of moisture-vapor permeable materials, and more preferably is constructed of sheepskin, leather, natural fur or furs or textiles having at least 25% by weight moisture-wicking fibers such as wool, cotton, polypropylene, linen, etc. The slipcover may be secured to the cushion-like support by loop-pad and hook-patch fastener strips (such as those sold under the trade name Velcro), zippers, laces, buttons or any other fastening means of the furrier and textile arts.

The cushion-like support may be fashioned in a wide variety of sizes. The preferred embodiment of the invention, illustrated in FIGS. 1 and 2, measures 47 inches in length along the proximal surface 50, 18 inches in width at the widest part of the arcuate body 20 and 10 inches in width at the widest part of the flared terminus 40 of the neck 30. The cushion-like support may be made in a number of sizes, however, to accommodate adult users of varying statures and to suit the special needs of children. For example, a children's size support may measure 34 inches in length along the proximal surface 50, 13 inches in width at the widest portion of the arcuate body 20 and 7 inches in width at the widest portion of the flared terminus 40 of the neck 30. The cushion-like supports may be manufactured in either of these sizes, or smaller or larger or in between. Furthermore, the cushion-like support need not have dimensions proportional to those given above, because it is the shape of the support as defined by the arcuate body which is essential to the invention, not the particular proportions of the body 20 and the neck 30.

Generally, the cushion-like support may range from 1 inch to 18 inches in thickness, and preferably from about 3 inches to about 14 inches in thickness. The preferred embodiment of the invention, illustrated in FIGS. 1 and 2, measures 9–10 inches thick. The particular thickness for any given application will depend on the stature of the user, and, most importantly, on the firmness of the bed or other support surface beneath the lower leg. Ordinarily, slimmer cushion-like supports are better suited for use on very firm mattresses, and thicker supports are more appropriate for softer surfaces.

In certain instances, the cushion-like support is designed and intended to be disposable. For example, an inexpensive, disposable support is particularly well-suited for use in hospital emergency and intensive care applications. The disposable support is ordinarily fashioned by carving from a single thickness of polyamidoester or rubber foam, or by injection-molding a mold having the proper shape with a foamable material and curing the material. If the support is injection-molded, a skin, having the same composition as the foam, may be formed on the outside of the support by methods known in the art. The surface of the support may be smooth or corrugated with the "egg carton" type depressions found in disposable foam mattress pads. The foam support may be used alone or in combination with a standard institutional pillowcase or sheet for additional hygiene and comfort.

The cushion-like support may be easily adapted into a stuffed toy for children. Because the support has a distinctive shape, it is well-suited to creative appliques which give the semblance of various fanciful creatures. The appliques may be sewn on or otherwise attached by the methods of the stuffed toy industry in general.

Although the invention has been described with reference to particular processes and materials, the invention is only to be limited so far as is set forth in the accompanying claims.

I claim:

1. A cushion-like support at least thirty four inches in length, adapted to be used by a user reclined on the side said support comprising a wider body portion, at least thirteen inches wide at its widest, adapted to be positioned between the two ankles two legs and two knees of the user in the knees drawn up position, a narrower neck portion integral with said body portion and adapted to the positioned adjacent the torso of the user, and extending to at least the shoulder area of the user, said neck and body portions being of approximately equal thickness and having a continuous, substantially linear proximal surface, said body portion having an arcute distal surface, said proximate and distal surfaces being substantially normal to the horizontal in the use position of the support.

2. The cushion-like support of claim 1 wherein said neck has a flared terminus thereon.

* * * * *

UNITED STATES PATENT AND TRADEMARK OFFICE

CERTIFICATE OF CORRECTION

PATENT NO. : 4,624,021

DATED : November 25, 1986

INVENTOR(S) : Jean A. Hofstetter

It is certified that error appears in the above-identified patent and that said Letters Patent is hereby corrected as shown below:

Column 1 Line 13 "draw" should read —drawn—.

Column 3 Line 66 "polycarbonate" should read —polycarbamate—.

Signed and Sealed this

Seventeenth Day of March, 1987

*Attest:*

DONALD J. QUIGG

*Attesting Officer*

*Commissioner of Patents and Trademarks*